US010940991B2

(12) United States Patent
Elalouf

(10) Patent No.: US 10,940,991 B2
(45) Date of Patent: Mar. 9, 2021

(54) DEVICE FOR STORING AND DISPLAYING KNITTING/CROCHETING NEEDLES

(71) Applicant: Sion Elalouf, Sands Point, NY (US)

(72) Inventor: Sion Elalouf, Sands Point, NY (US)

(73) Assignee: Knitting Fever, Inc., Amityville, NY (US)

( * ) Notice: Subject to any disclaimer, the term of this patent is extended or adjusted under 35 U.S.C. 154(b) by 0 days.

(21) Appl. No.: 15/586,405

(22) Filed: May 4, 2017

(65) Prior Publication Data

US 2018/0319578 A1 Nov. 8, 2018

(51) Int. Cl.

| | |
|---|---|
| ***B65D 85/24*** | (2006.01) |
| ***D04B 37/00*** | (2006.01) |
| ***A45C 11/24*** | (2006.01) |
| ***A45C 13/10*** | (2006.01) |
| ***A45C 13/02*** | (2006.01) |
| ***D04B 33/00*** | (2006.01) |
| ***D04B 3/00*** | (2006.01) |

(52) U.S. Cl.

CPC ..... *B65D 85/24* (2013.01); *A45C 11/24* (2013.01); *A45C 13/02* (2013.01); *A45C 13/1076* (2013.01); *D04B 3/00* (2013.01); *D04B 33/00* (2013.01); *D04B 37/00* (2013.01); *A45C 2200/15* (2013.01)

(58) Field of Classification Search

CPC ..... B65D 85/24; B65D 85/28; B65D 85/20; B65D 5/5286; B65D 5/5293; B65D 5/522; B65D 5/5213; B65D 5/526; B65D 5/524; B65D 5/5226; B65D 85/08; B65D 85/10; B65D 85/12; B65D 85/14

USPC ..... 206/736, 756, 759, 760, 762, 382, 383, 206/380, 443, 574, 739, 757, 767

See application file for complete search history.

(56) References Cited

U.S. PATENT DOCUMENTS

| | | | |
|---|---|---|---|
| 35,596 | A | 6/1862 | Farmer |
| 172,225 | A | 1/1876 | Wetmore |
| 610,859 | A | 9/1898 | Gleason |
| 830,609 | A | 9/1906 | Metzger |
| 900,236 | A | 10/1908 | Tower |
| 1,372,648 | A | 3/1921 | Crowell |

(Continued)

FOREIGN PATENT DOCUMENTS

| | | |
|---|---|---|
| FR | 2 577 124 | 8/1986 |

*Primary Examiner* — Allan D Stevens

(74) *Attorney, Agent, or Firm* — Thomas A. O'Rourke; Bodner + O'Rourke, LLP

(57) ABSTRACT

A knitting needle storage/display device includes a display flap, and a main flap, which is foldable at first and second fold regions, to form a first end flap portion, a middle flap portion, and a second end flap portion. A strap, being intermittently secured to the display flap, releasably supports a knitting needle between adjacent pairs of intermittently secured locations. The display flap, being secured to the main flap, can be folded between its first and second ends into a display position, and be releasably secured thereat using hook and loop fastening materials. The folded display flap in the display position exposes the ends of the needles. Snap members releasably secure the first and the second end flap portions together, when respectively folded at the first and second fold regions, in either a closed position, or an open position while the display flap is in the display position.

2 Claims, 6 Drawing Sheets

(56) References Cited

U.S. PATENT DOCUMENTS

| | | | | |
|---|---|---|---|---|
| 2,545,611 | A * | 3/1951 | Flannery | D04B 3/00 206/380 |
| 2,551,012 | A | 5/1951 | Kenah | |
| 2,585,476 | A | 2/1952 | Lerner | |
| 2,628,711 | A | 2/1953 | Flannery | |
| 2,718,131 | A | 9/1955 | Black | |
| 2,928,534 | A | 3/1960 | Chiu | |
| 3,004,660 | A | 10/1961 | Hoffmann | |
| 3,052,391 | A | 9/1962 | Tracy | |
| 3,084,788 | A | 4/1963 | Ford | |
| 4,108,397 | A | 8/1978 | Hauck | |
| 4,310,313 | A | 1/1982 | Brundige | |
| D275,150 | S | 8/1984 | Haws | |
| 4,478,333 | A | 10/1984 | Dalbo | |
| 6,283,299 | B1 * | 9/2001 | Lee | G06F 1/1628 206/320 |
| 6,345,743 | B1 | 2/2002 | Dellamar | |
| D500,919 | S | 1/2005 | MacKay | |
| 8,196,743 | B2 | 6/2012 | Stingel | |
| 8,602,211 | B2 | 12/2013 | Sasur | |
| 9,481,951 | B2 | 11/2016 | Fegley | |
| 2006/0037880 | A1 * | 2/2006 | Wang | B25H 3/003 206/372 |
| 2009/0223845 | A1 * | 9/2009 | Bosma | A45C 7/0045 206/320 |
| 2012/0090215 | A1 * | 4/2012 | Buie, II | F41A 29/00 42/95 |

* cited by examiner

DEVICE FOR STORING AND DISPLAYING KNITTING/CROCHETING NEEDLES

FIELD OF THE INVENTION

The present invention relates to cases and holders for knitting/crocheting needles and other accessories, and more particularly to a case that is particularly configured to accommodate both storing of a plurality of knitting/crocheting needles, and displaying of the same needles in a manner that provides for easy access and removal by the knitter.

BACKGROUND OF THE INVENTION

The process of knitting/crocheting involves the use of at least two needles to interconnect loops of yarn or wool into a garment. The use of needles in a knitting/crocheting process dates back to ancient Egypt, when it was utilized primarily as a means for producing fabric. During the 1980s the availability of low cost machine-knitted garments caused a sharp decline in the popularity of home knitting/crocheting. However, the early 21$^{st}$ century has seen a resurgence in knitting/crocheting, even beyond that of a basic hobby, as evidenced by the 2006 Knitting Olympics, and the emergence of the social networking site "Ravelry" for the international community of knitters, weavers, spinners, and crocheters.

There have been a number of devices conceived for assisting the knitter with storing the assortment of knitting needles that may ordinarily tend to be used, as shown by the following.

U.S. Pat. No. 1,372,648 to Crowell is for a "Knitting Needle Holder." Crowell teaches a pair of holding caps that are configured to be positioned over the ends of the knitting needles, where the caps are connected by a coil spring, with the contraction of the spring intended to draw the caps tightly over the ends of the needles.

U.S. Pat. No. 2,551,012 to Kenah is for a Knitting Needle Carrier. Kenah teaches an elongated panel-like body that is formed with a plurality of V-shaped, U-shaped, or square-shaped corrugations throughout its length, which serve as needle receiving grooves. The panel is constructed in length so that the head at the end of the needle would engage the end of the carrier body to limit movement of the needle. Withdrawal of a needle from an associated corrugation of the panel-like body is through the use of "fingers" that may be turned upwardly.

U.S. Pat. No. 2,628,711 to Flannery is for a Knitting Needle Kit. The Flannery needle kit is formed of a sheet of cloth or leather or plastic, which is folded to form a flap, and has strips secured thereto that have spaced openings configured to support needles. Flannery teaches that its flap structure provides a means for raising the headed end of the pins.

U.S. Pat. No. 4,478,333 to Dalbo is for a Needlecraft Case with Extenders. Dalbo teaches a case that has three sections that are hinged together so that the case can be folded into thirds, with each of the thirds having storage pockets. Dalbo teaches that at least one of the pockets is adapted for storing flat objects such as booklets and instructions. Dalbo also teaches that one of the pockets is configured to receive elongate items such as knitting needles. Dalbo further teaches that various sub-pockets can have various widths to receive large diameter needles, or small diameter needles, etc.

U.S. Design Patent No. D500,919 to MacKay is for a Knitting/Crochet Needle Caddy with Integrated Tape Measure. The MacKay caddy includes respectively numbered pockets for each of the needles.

U.S. Pat. No. 8,196,743 to Stingel is for a Needle-Receiving Device that has a flat needle carrier section, and a clamping lip that is pivotally connected thereto. A spring pretensions the clamping lip against the needle carrier. The needles are thus held lying next to each other and in contact with each other on the needle carrier section.

U.S. Pat. No. 9,481,951 to Fegley is for a knitting needle holder that has a body having a lid pivotally coupled thereto. The body is formed with a recessed channel configured to hold knitting needles therein.

The device disclosed herein provides improvements to these and other knitting needle storage devices.

OBJECTS OF THE INVENTION

It is an object of the invention to provide a case for storing knitting/crocheting needles of various types, diameters, and lengths.

It is another object of the invention to provide a case that is transformable from a configuration adapted for mere storage of the knitting/crocheting needles, into a configuration adapted for displaying of the needles.

It is a further object of the invention to provide for easy access and removal of each of the knitting/crocheting needles from the display configuration of the case.

It is another object of the invention to provide a flexible knitting/crocheting needle case that may be folded upon itself.

It is also an object of the invention to provide a quick release means, such as a snap, for securing the flaps of the device in a closed position.

It is another object of the invention to provide a quick release means, such as a snap, for securing the flaps of the device in a display position.

Further objects and advantages of the invention will become apparent from the following description and claims, and from the accompanying drawings.

SUMMARY OF THE INVENTION

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

In accordance with at least one embodiment of the present invention, a knitting needle storage and display device may broadly include: a main flap, a display flap, and a strap. The main flap may be configured to be folded at a first fold region and at a second fold region, to form a first end flap portion, a middle flap portion, and a second end flap portion. The display flap may have a front side and a rear side, and may have a first end and a second end. The first end of the display flap may be secured to the main flap, and the display flap may be configured to be folded at a display flap fold region between its first and rear ends. The strap may be fixedly secured to the front side of the display flap at a plurality of spaced apart locations, to releasably support a knitting needle between each adjacent pair of the spaced apart securement locations.

The display flap being folded at the display flap fold region between its first and second ends, may occupy a display position that exposes a portion of the ends of the knitting needles. The display flap may be releasably secured in the display position using any suitable releasably attachment mechanism, including, but not limited to, hook and loop type fabric materials which are descriptive names for materials that are commonly known by and are sold under the trademarked name of VELCRO®. In one embodiment, the hook-type fabric material may be fixedly secured at a selective location on the second side of the display flap, and the loop-type fabric material may be fixedly secured to the middle flap portion, at a selective location configured to releasable secure the hook-type fabric material to the loop-type fabric material, to form a bend in the display flap at the display flap fold region, to position the display flap in the display position. (Note that the positioning of the hook-type material and the loop-type materials may be reversed).

The knitting needle storage and display device may also include a securement mechanism to secure the first end flap portion and the second end flap portion together, when respectively folded at the first fold region and the second fold region in a closed position. The securement mechanism may be, in one embodiment, a first snap member (male or female) secured to the first end flap portion, and a second snap member (the other of the male or female snap members) secured to the second end flap portion. The securement mechanism, e.g., the snap members, may also be configured to be releasably coupled to each other to secure the first end flap portion and the second end flap portion together, when respectively folded at the first fold region and the second fold region in an open position, while the display flap is releasably secured in the display position.

When in the display position the portion of the display flap holding the knitting needles may be at any desired angle with respect to the main flap, and may range anywhere from being flush thereto (i.e., a zero degree angle), to being supported at a 180 degree angle. In one embodiment, the display position for the display flap may be at an angle with respect to the main flap being in the range of zero degrees (see FIG. 6) and ninety degrees (i.e., perpendicular to the main flap, with the display flap generally oriented in a vertical direction, when the device is positioned on a horizontal surface such as a table—see FIG. 8). Note that the display flap fold region may vary in location depending upon how the display flap is bent during releasable attachment to the main flap using the attachment mechanism. Also note that to achieve angles greater than ninety degrees, the display flap may be extended in length, and the bend may result in two unequal portions, unlike the equal-length leg portions shown in FIG. 8.

BRIEF DESCRIPTION OF THE DRAWINGS

The description of the various example embodiments is explained in conjunction with appended drawings, in which.

Figure 1:
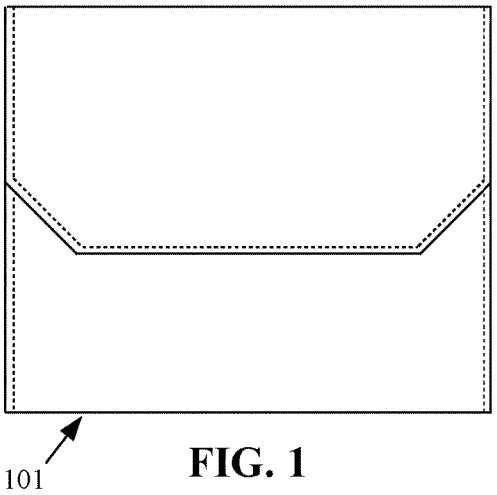
FIG. 1 is a front view of a first embodiment of a device for storing and displaying knitting/crocheting needles, in accordance with the present invention.
Figure 5:
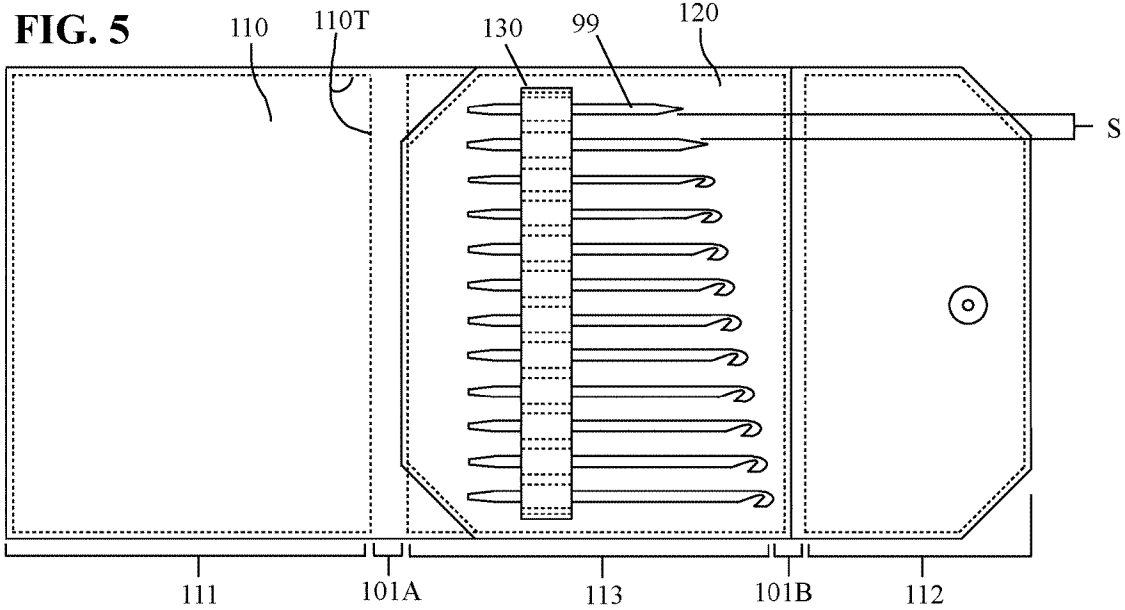
FIG. 5 shows the unfolded device of FIG. 3 with the first end flap portion and the second end flap portion in a first open position, but is shown rotated ninety degrees, and additionally shows a plurality of knitting/crocheting needles received with the display flap.
Figure 6:
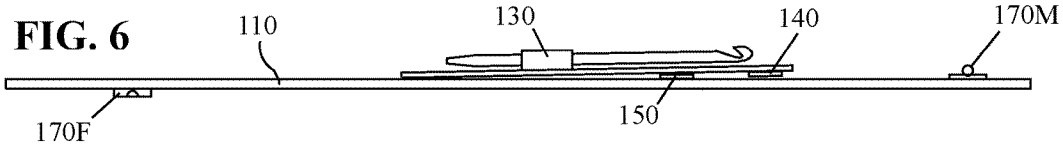
Figure 7:
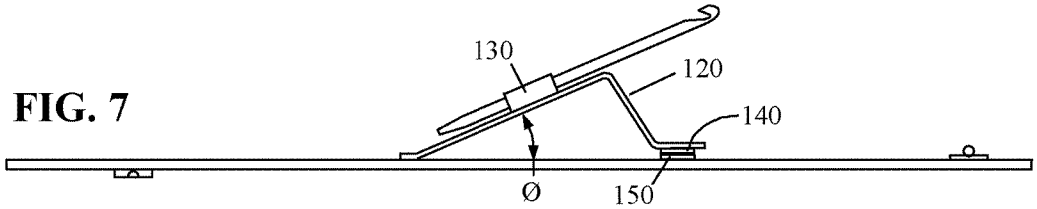
Figure 8:
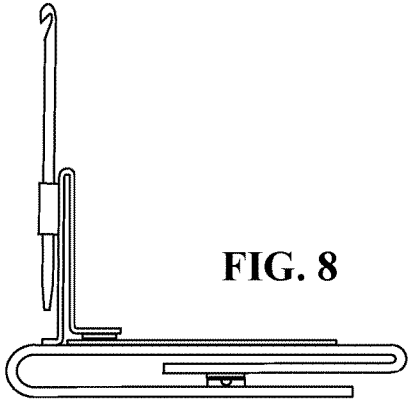
Figure 5A:
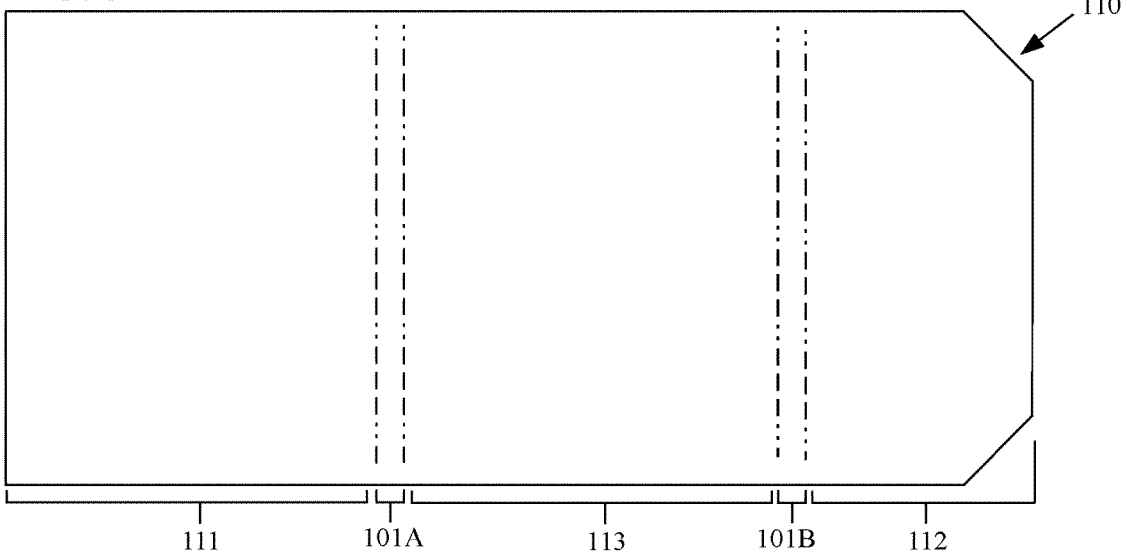
FIG. 5A shows an elongated strip of flexible material that may be usable for a main flap of the device shown in FIG. 5.
Figure 5B:
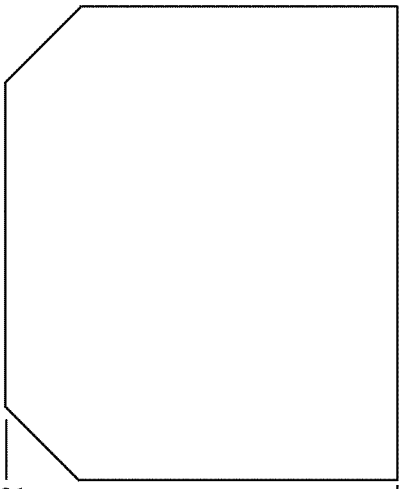
FIG. 5B shows a piece of material that is usable for the display flap of the device of FIG. 5.
Figure 5C:
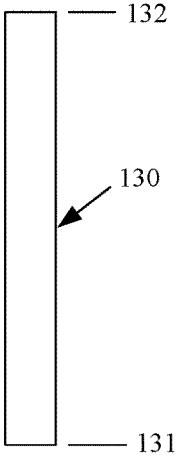
Figure 5D:
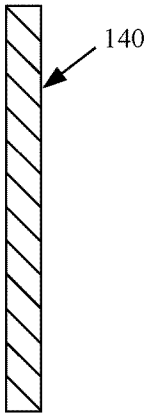
Figure 5E:
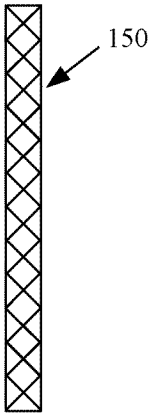
Figure 11:
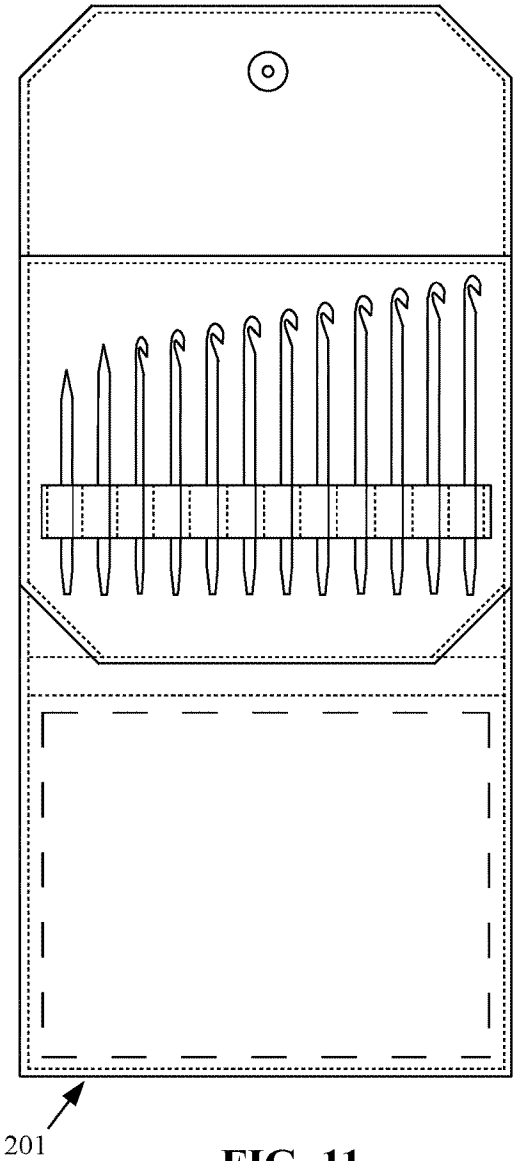
Figure 10:
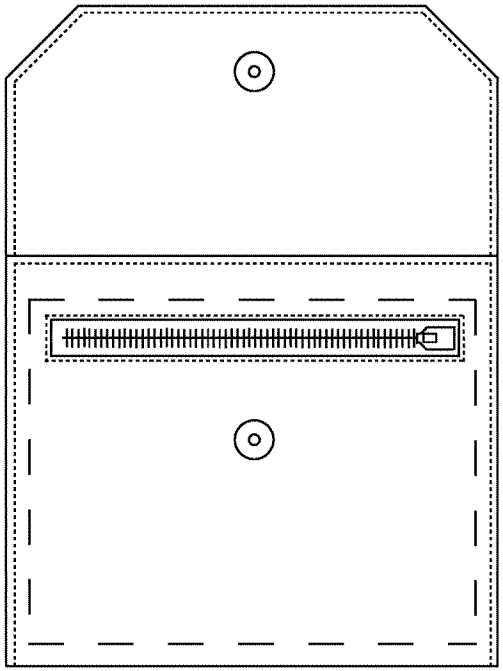
Figure 9:
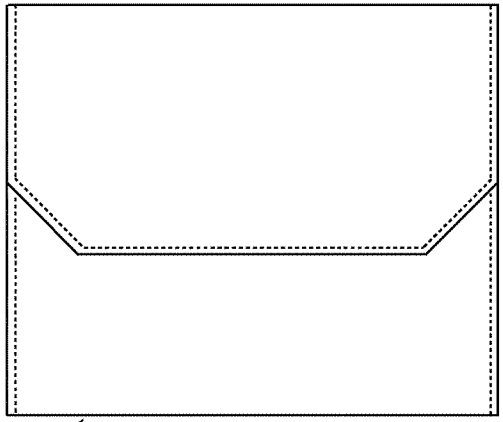
Figure 14:
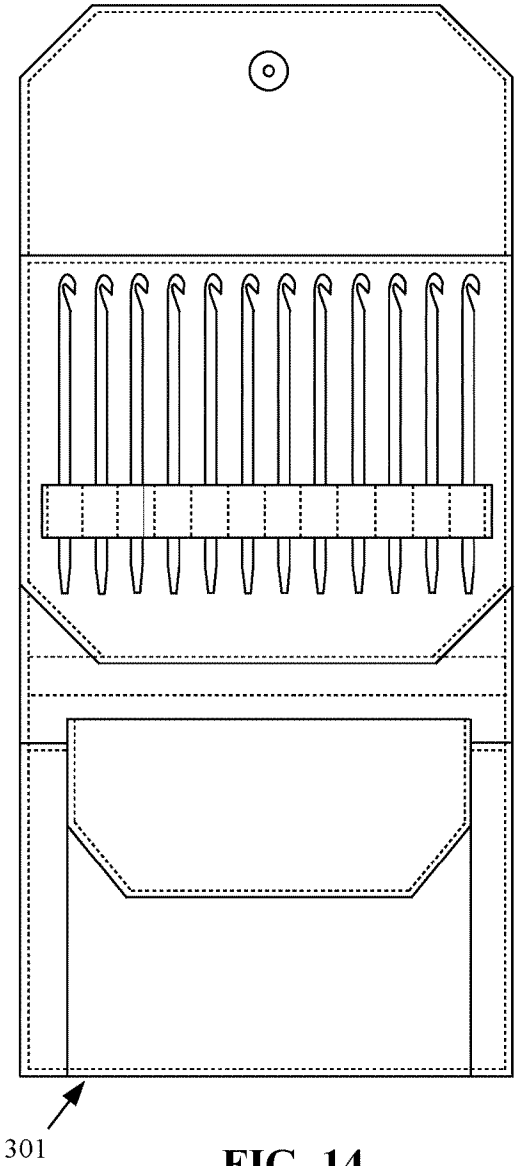
Figure 13:
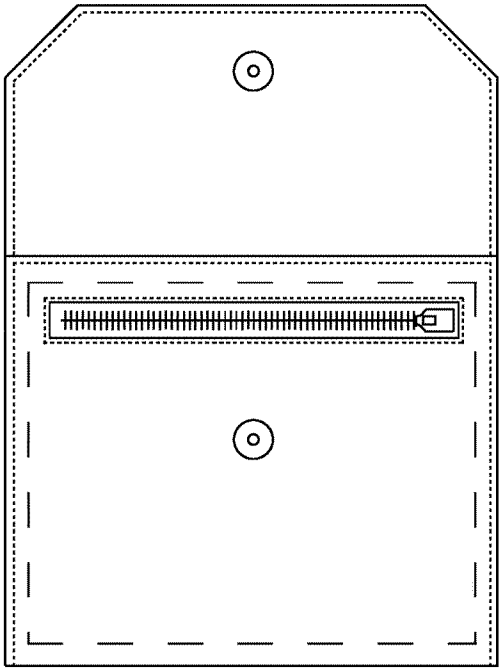
Figure 12:
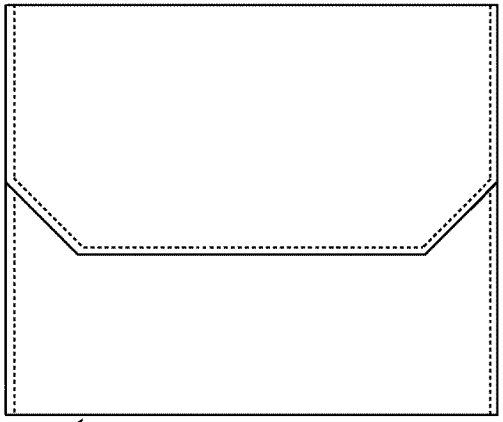
Figure 15:
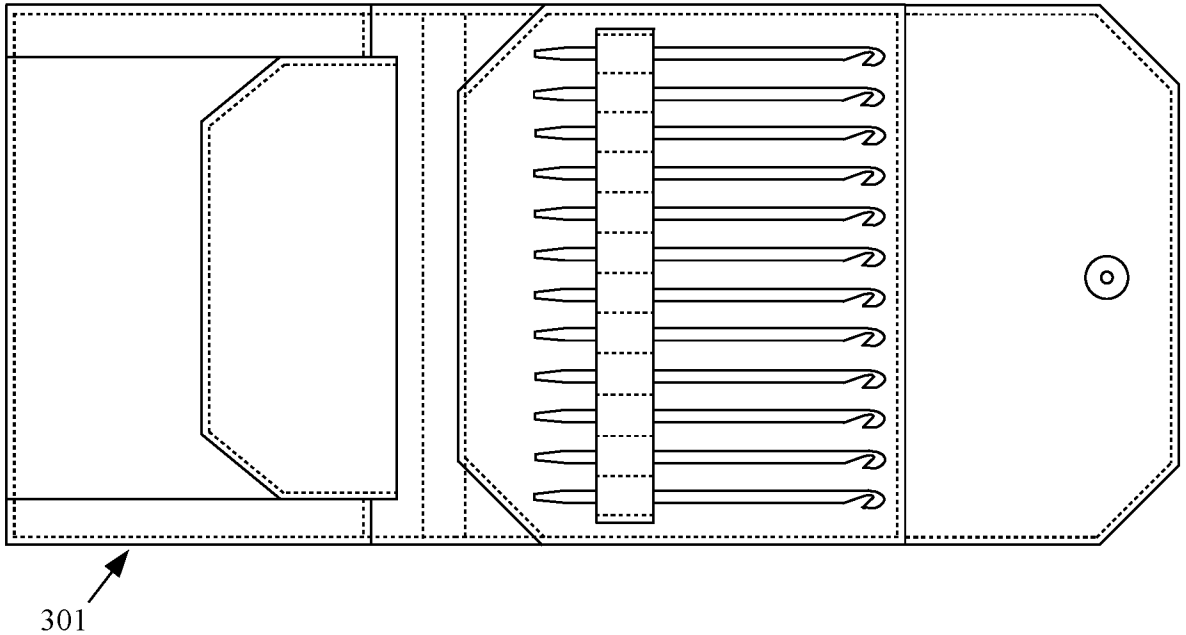
Figure 16:
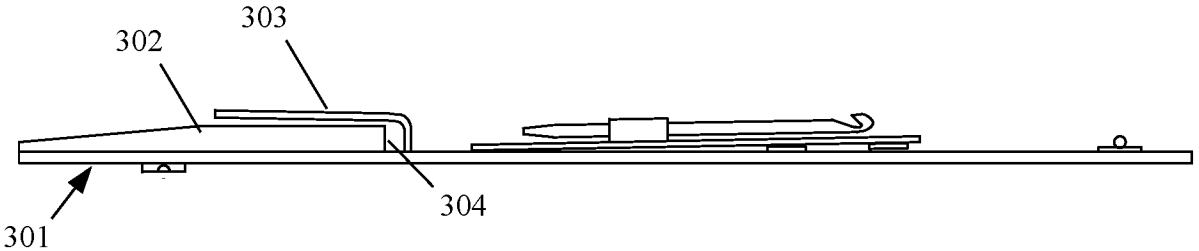

FIG. SC shows a strip of elastic material that may be secured to the display flap of the device of FIG. 5, being usable for securing knitting/crocheting needles thereto;

FIGS. 5D and 5E show respective pieces of hook material and loop material for releasably securing the display flap in a display position;

FIG. 6 is a side view of the unfolded device shown in FIG. 5, with the display flap into a flattened position and the knitting/crocheting needles shown in a stowed position;

FIG. 7 is the side view of FIG. 6, but is shown with the display flap having been moved into and secured at a V-shaped display position, for the knitting/crocheting needles to move into an elevated position with respect to the main flap;

FIG. 8 is the side view of the device of FIG. 1, with the display flap and knitting/crocheting needles in the display position of FIG. 7, but is shown with the first end flap portion and the second end flap portion having been folded backwardly and snapped together to occupy a second open position, for the device to serve as a compact stand;

FIG. 9 is a front view of a device for storing and displaying knitting/crocheting needles, in accordance with a second embodiment of the present invention;

FIG. 10 is the front of FIG. 9, but is shown with the first end flap portion of the device having been unsnapped and unfolded, to expose a zippered pocket in the second end flap portion;

FIG. 11 is the front view of FIG. 10, but is shown with the second end flap portion of the device having also been unfolded to expose a plurality of knitting/crocheting needles releasably stored in the display flap;

FIG. 12 is a front view of a device for storing and displaying knitting/crocheting needles, in accordance with a third embodiment of the present invention;

FIG. 13 is the front view of FIG. 12, but is shown with the first end flap portion of the device having been unsnapped and unfolded, to expose a zippered pocket;

FIG. 14 is the front view of FIG. 13, but is shown with the second end flap portion of the device having also been unfolded to exposed a plurality of knitting/crocheting needles releasably stored in the display flap, and to expose a storage compartment secured to the second end flap portion;

FIG. 15 shows the unfolded device of FIG. 14, but is shown rotated ninety degrees; and FIG. 16 is a side view of the unfolded device shown in FIG. 15, with the display flap and knitting/crocheting needles shown in a stowed position.

DETAILED DESCRIPTION OF THE INVENTION

As used throughout this specification, the word "may" is used in a permissive sense (i.e., meaning having the potential to), rather than the mandatory sense (i.e., meaning must). Similarly, the words "include", "including", and "includes" mean including but not limited to.

The phrases "at least one", "one or more", and "and/or" are open-ended expressions that are both conjunctive and disjunctive in operation. For example, each of the expressions "at least one of A, B and C", "one or more of A, B, and C", and "A, B, and/or C" mean all of the following possible combinations: A alone; or B alone; or C alone; or A and B together; or A and C together; or B and C together; or A, B and C together.

Also, all references (e.g., patents, published patent applications, and non-patent literature) that are cited within this document are incorporated herein in their entirety by reference.

Furthermore, the described features, advantages, and characteristics of any particular embodiment disclosed herein, may be combined in any suitable manner with any of the other embodiments disclosed herein.

A device 101 for storing and displaying knitting/crocheting needles, as shown in FIGS. 1-8, may generally be constructed in one of several different ways. In its simplest form, device 101 may have a main flap 110 (FIGS. 5 and 5A) that may be in the form of an elongated strip of material that is flexible, so that it may freely be folded somewhere within a first fold region 101A and within a second fold region 101B, to form a first end flap portion 111, a second end flap portion 112, and a middle flap portion 113. The main flap 110, as well as any of the other components of the device 101, may be formed of any suitable material, including, but not limited to, leather, suede, cloth, vinyl or other plastic materials, etc. In another embodiment, the main flap 110 may have additional pieces of the same material (or a different material type) stitched thereto using threading 110T (FIG. 5), and/or may have cardboard or other filler material added thereto to increase its thickness/stiffness in the non-folded regions (i.e., at flap portions 111 and 112 and 113), which may tend to dictate that folding would occur primarily within, or only within, the pre-determined fold regions 101A and 101B.

Figure 3:
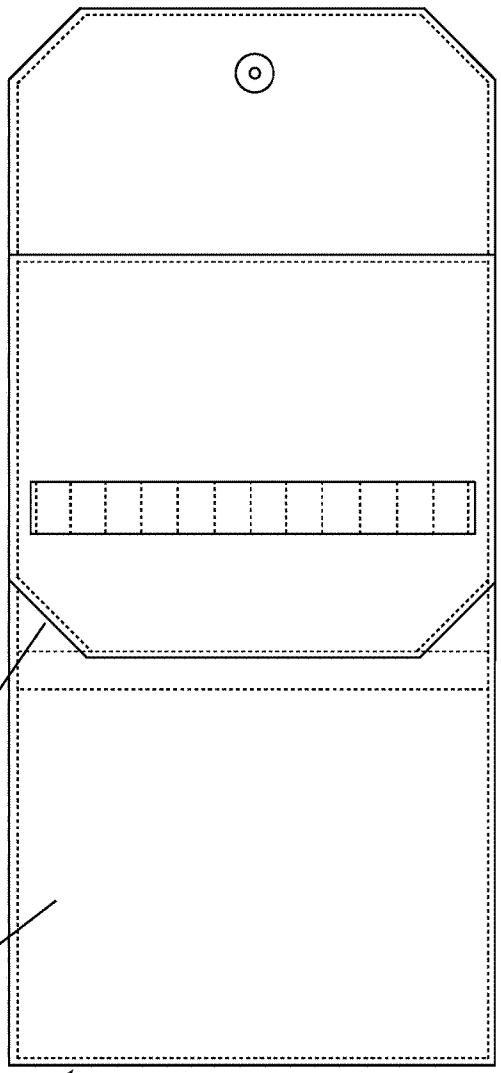
FIG. 3 is the front view of FIG. 2, but is shown with the second end flap portion of the device having also been unfolded to exposed a display flap that may receive and releasably store a plurality of knitting/crocheting needles, when positioned in a storage configuration.
Figure 2:
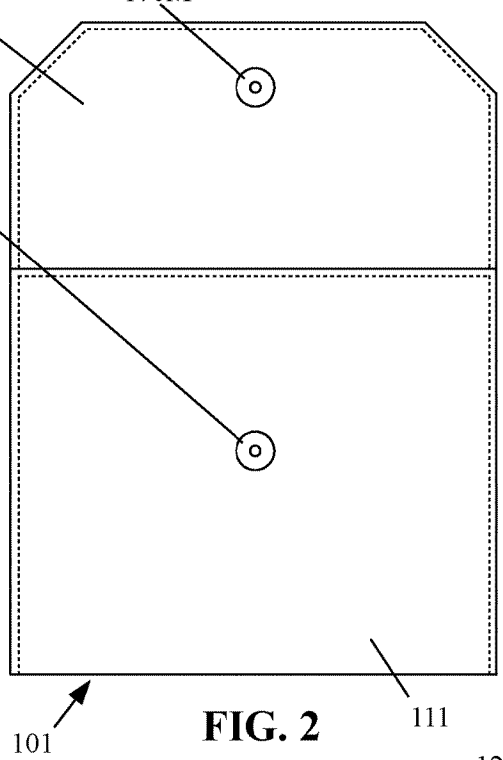
FIG. 2 is the front view of FIG. 1, but is shown with the first end flap portion of the device having been unsnapped and unfolded.
Figure 4:
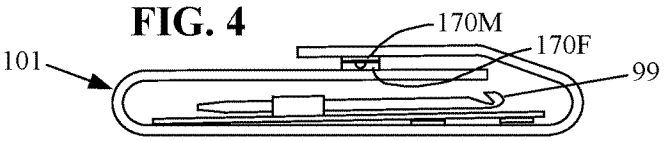
FIG. 4 illustrates a side view of the folded device shown within FIG. 1, and also shows at least one knitting/crocheting needle stored therein.

As seen in FIG. 2, the first end flap portion 111 and the second end flap portion 112 may respectively have a male snap member 170M and a female snap member 170F secured thereto, to permit those flap portions 111 and 112 to be releasably snapped together when in a closed position, as shown in FIG. 1 and FIG. 4. Any suitable snap assembly known in the art may be used, including, but not limited to, the snap assembly disclosed by U.S. Pat. No. 3,975,803 to Katayama, the snap assembly shown by U.S. Pat. No. 1,965,115 to Fenton, etc. Also, any other means of releasable securement known in the art may alternatively be used, including, but not limited to, a strap and buckle combination (e.g., U.S. Pat. No. 2,899,732 to Cushman); or a piece of hook-type fabric material and a piece of loop-type fabric material, which are descriptive names for materials that are commonly known by and sold under the trademarked name of VELCRO®, and which are known to releasably couple to each other; etc.

A display flap 120 may have a front side (shown in FIG. 5 and FIG. 5B) and a rear side, and may have a first end 121 and a second end 122. The display flap 120 may be formed to be square-shaped, rectangular-shaped, or any other suitable shape, and may also have angled (i.e., chamfered) corners at its periphery, as shown in FIG. 5B. As seen in FIG. 5, the first end 121 of the display flap 120 may be fixedly secured to the main flap 110, and may be so secured using any method known in the art, including, but not limited to, being bonded thereto using adhesive/epoxy, or being stitched/sewn thereto using thread, or being mechanically fastened thereto using rivets or other fasteners, etc.

A strip of material 130 (FIG. 5C) may be secured to the front side of the display flap 120 using similar methods, and may be secured thereto proximate to each of the ends 131 and 132 of the strip of material. The strip of material 130 may also be secured to the display flap 120 at a plurality of intermittent locations along its length to produce a series of semicircular-shaped loops, with each loop configured to releasably receive a knitting/crocheting needle 99 therein (i.e., between each adjacent pair of the intermittently secured locations), as seen in FIG. 5 and FIG. 6. In one embodiment, the strip of material 130 may be formed of the same type of material as the main flap 110. In another embodiment, the strip of material 130 may be formed of a different material, including, but not limited to, an elastic material that may be able to conform to, and readily accommodate receiving various different sized knitting/crocheting needles 99. Therefore, where elastic is used for the strip of material 130, it may not tend to form the semicircular-shaped loops, and may instead tend to remain flat until being elastically deformed/displaced by a knitting/crocheting needle being inserted between the elastic and the display flap 120, between two adjacent stitched locations.

On the rear side of the display flap 120 and on the inside of the middle flap portion 113, as seen in FIG. 6, may respectively be secured a piece of hook-type fabric material and a piece of loop-type fabric material. The hook-type fabric material 140 shown in FIG. 5D being fixedly secured at the selective location on the rear side of the display flap shown in FIG. 6, and the loop-type fabric material 150 shown in FIG. 5E being fixedly secured to the selective location on the middle flap portion, may permit releasable securing of the hook-type fabric material to the loop-type fabric material to form a bend in the display flap at a fold region therein, as seen in FIG. 7. Note that the respective positioning of the piece of loop-type material and the hook-type material may be reversed, and also that other types of releasable securement may alternatively be used, including, but not limited to, a snap assembly, a buckle, etc.

To provide for adjustments to the angle (θ) at which one side of the display flap may be positioned (compare FIG. 7 and FIG. 8), one or more additional pieces of the loop-type fabric material may be used. Alternatively, as seen in FIG. 8, a larger single piece may be used for the loop-type/hook-type fabric material, permitting releasable securement thereto of the other fabric material at a desired position, to produce any desired angular relationship (θ) from among a range of such possible angular relationships. The loop-type fabric material 150 may be sized and positioned to permit releasable securement to produce an angular relationship (θ) in the range of 0.0 degrees to 180 degrees. In one embodiment, the loop-type fabric material 150 may preferably be sized and positioned to permit securements to produce an angular relationship (θ) in the range of 0.0 degrees to 90 degrees.

It is noted that in another embodiment, the hook-type fabric material may alternatively or additionally be positioned on the top of the display flap 120 and may be secured to the loop-type fabric material by the end of the display flap being folded underneath itself.

It is also noted that the display flap fold region may vary in location depending upon how the display flap is bent during releasable attachment to the main flap using the hook and loop fastening materials. Also, to achieve angles greater than ninety degrees, the display flap may be extended in length, and the bend in the display flap fold region may result in two unequal portions, unlike the equal-length leg portions shown in FIG. 8.

The side view of FIG. 8 also illustrates that the device 101, with the display flap and knitting/crocheting needles releasably secured in the display position, may also have its first end flap portion and second end flap portion folded backwardly, and may be snapped together using the snaps to serve as a compact stand. This arrangement would require a much smaller footprint when placed upon a convenient nearby surface that may be available to the knitter (e.g., a night stand with a small top surface).

The bend region in the display flap 120 may be located in sufficiently close proximity to the elastic strip of material 130 in order to ensure exposing of a portion of the ends of each of the knitting/crocheting needles 99, including the shortest needle stored therein. This may permit the user to approach and grasp the top and bottom of an end of a desired needle with his/her the thumb and forefinger, without regard to the spacing between the needles. However, the intermittent securement locations for the strip of material 130 to the display flap 120 may also be sufficiently spaced apart, so that the user may also be able to place his/her fingers between any two adjacent needles to easily select the desired needle when needed. As shown in FIG. 5, the intermittently spaced securement of the strip of material 130 to the display flap 120 may provide a spacing S between the knitting/crocheting needles, which may be correlated to the size (diameter) of typical knitting/crocheting needles, and the size of the person's finger. Although other spacing values may also be used, in one embodiment, the spacing S may be in the range of 0.1 inches to 2.5 inches, and may in one embodiment may be the same for each of the intermittently spaced securements of the strip of material 130.

In another embodiment, the spacing S may be different for each of the intermittently spaced securements of the strip of material 130 to the display flap 120, to individually and particularly accommodate a range of different needle sizes (diameters).

Since the typical ring size for men is between an 8 and a 12, which equates to a typical finger size diameter being in the range of 18.1 mm (0.71 inch) to 21.4 mm (0.84 inch), and since knitting/crocheting needle diameters range from 2.25 mm (0.09 inches) up to 15 mm (0.59 inches), 19 mm (0.74 inches), and 25 mm (0.98), in one embodiment, the spacing S may range from 0.8 inches (smallest typical male finger and smallest needle diameter) to 1.8 inches (largest typical male finger and largest needle diameter). In another embodiment, to accommodate spacing for an assortment of knitting/crocheting needle sizes, double securements of the strip of material 130 to the display flap 120 may be used, as seen in FIG. 5.

FIG. 9 is a front view of a device 201 for storing and displaying knitting/crocheting needles, in accordance with a second embodiment of the present invention. FIG. 10 is the front of FIG. 9, but is shown with the first end flap portion of the device 201 having been unsnapped and unfolded, to expose a zippered pocket in the second end flap portion. FIG. 11 is the front view of FIG. 10, but is shown with the second end flap portion of the device 201 having also been unfolded to expose a plurality of knitting/crocheting needles releasably stored in the display flap.

FIG. 12 is a front view of a device 301 for storing and displaying knitting/crocheting needles, in accordance with a third embodiment of the present invention. FIG. 13 is the front view of FIG. 12, but is shown with the first end flap portion of the device 301 having been unsnapped and unfolded, to expose a zippered pocket. FIG. 14 is the front view of FIG. 13, but is shown with the second end flap portion of the device 301 having also been unfolded to expose a plurality of knitting/crocheting needles releasably stored in the display flap, and to expose a storage compartment 302 secured to the second end flap portion. FIG. 15 shows the unfolded device 301 of FIG. 11, but is shown rotated. FIG. 16 is a side view of the unfolded device 301 shown in FIG. 15, with the display flap and knitting/crocheting needles shown in a stowed position, and which also shows a cover member 303 that extends over the storage compartment 302 to cover a substantial portion of an opening 304 into the compartment.

While illustrative implementations of one or more embodiments of the present invention are provided hereinabove, those skilled in the art and having the benefit of the present disclosure will appreciate that further embodiments may be implemented with various changes within the scope of the present invention. Other modifications, substitutions, omissions and changes may be made in the design, size, materials used or proportions, operating conditions, assembly sequence, or arrangement or positioning of elements and members of the exemplary embodiments without departing from the spirit of this invention.

Accordingly, the breadth and scope of the present disclosure should not be limited by any of the above-described example embodiments, but should be defined only in accordance with the following claims and their equivalents.

What is claimed is:

1. A knitting needle storage and display device comprising:

a main flap having a first side and a second side, and a first end and a second end, said main flap formed of a flexible material and comprising a first end flap portion, a middle flap portion, and a second end flap portion, wherein the first end flap portion, the middle flap portion, and the second end flap portion are each located between said first and second ends, wherein the first end flap portion and the middle flap portion are separated by a first fold region and the middle flap portion and the second end flap portion are separated by a second fold region, wherein said main flap is configured to be folded from a first open position;

a display flap having a first side and a second side, and having a first end and a second end, said first end of said display flap being secured to said main flap; said display flap configured to be folded at a display flap fold region between said first end and said second end of the display flap;

a hook-type fabric material fixedly secured at a selective location on a rear side of said display flap; and a loop-type fabric material fixedly secured to said middle flap portion at a selective location to releasably secure said hook-type fabric material to said loop-type fabric material, to form a bend in said display flap at said display flap fold region, to position a portion of said display flap in a display position at a bend angle with respect to said middle flap portion; wherein when said main flap is in said first open position and the display flap is unbent with the book-type fabric material facing the main flap, said first and second sides of said display flap are collinear with said first and second sides of said main flap, at least a portion of said first end of said display flap extends at least up to said first fold region, and said second end of said display flap extends at least up to said second fold region;

an elastic strap, said elastic strap fixedly secured at a plurality of intermittent locations to said display flap, to releasably support a plurality of knitting needles with a knitting needle supported between adjacent pairs of said intermittently secured locations;

wherein said elastic strap fixedly secured at said plurality of intermittent locations is further configured to support the plurality of knitting needles in an elevated position to expose a portion of an end of each knitting needle when said display flap is releasably secured at said bend angle in said display position;

wherein said plurality of intermittently secured locations are respectively spaced apart different amounts, for use in supporting a range of different diameters of different needle sizes a first snap member secured to said first end flap portion;

a second snap member secured to said second end flap portion;

wherein said first snap member and said second snap member are configured to releasably couple to each other to secure said first end flap portion and said second end flap portion together, when respectively folded at said first fold region and said second fold region, for said main flap to occupy a closed position; and wherein said first snap member and said second snap member are further configured to releasably couple to each other to secure said first end flap portion and said second end flap portion together, when respectively folded backwardly at said first fold region and said second fold region for said main flap to occupy a second open position for said storage and display device to form a compact stand when in use, with said hook-type fabric material of said display flap releasably secured to said loop-type fabric material of said middle flap portion in said display position.

2. The knitting needle storage and display device according to claim 1, wherein said selective location for said loop-type fabric material on said middle flap portion provides for said bend angle being in the range of zero degrees to 180 degrees.

* * * * *